US010883764B2

(12) United States Patent
Sasaki et al.

(10) Patent No.: US 10,883,764 B2
(45) Date of Patent: Jan. 5, 2021

(54) DOOR STRUCTURE OF HEAT TREATMENT FURNACE

(71) Applicant: DOWA THERMOTECH CO., LTD., Tokyo (JP)

(72) Inventors: Kazuya Sasaki, Aichi (JP); Takahiro Fujita, Shizuoka (JP)

(73) Assignee: DOWA THERMOTECH CO., LTD., Tokyo (JP)

( * ) Notice: Subject to any disclaimer, the term of this patent is extended or adjusted under 35 U.S.C. 154(b) by 174 days.

(21) Appl. No.: 16/081,766

(22) PCT Filed: Mar. 21, 2017

(86) PCT No.: PCT/JP2017/011210

§ 371 (c)(1),
(2) Date: Aug. 31, 2018

(87) PCT Pub. No.: WO2017/164170

PCT Pub. Date: Sep. 28, 2017

(65) Prior Publication Data

US 2019/0024979 A1 Jan. 24, 2019

(30) Foreign Application Priority Data

Mar. 25, 2016 (JP) ..... 2016-061800

(51) Int. Cl.
*F27D 7/06* (2006.01)
*F27D 1/18* (2006.01)
(Continued)

(52) U.S. Cl.
CPC ..... *F27D 7/06* (2013.01); *F27B 9/20* (2013.01); *F27B 9/30* (2013.01); *F27B 9/32* (2013.01); *F27D 1/1858* (2013.01)

(58) Field of Classification Search
CPC ..... F27B 9/20; F27B 9/30; F27B 9/32; F27D 1/1858; F27D 7/06
(Continued)

(56) References Cited

U.S. PATENT DOCUMENTS 3,760,792 A * 9/1973 White ..... F24C 15/04 126/198
8,182,263 B2 * 5/2012 Choi ..... C21D 1/00 432/129
(Continued)

FOREIGN PATENT DOCUMENTS

CH 615977 A5 2/1980
JP 56-88100 7/1981
(Continued)

OTHER PUBLICATIONS

Official Communication issued in International Bureau of WIPO Patent Application No. PCT/JP2017/011210, dated Jun. 20, 2017, along with an english translation thereof.
(Continued)

*Primary Examiner* — Scott R Kastler
*Assistant Examiner* — Michael Aboagye
(74) *Attorney, Agent, or Firm* — Greenblum & Bernstein, P.L.C.

(57) ABSTRACT

In a door structure of a heat treatment furnace performing a heat treatment of a workpiece, there are provided: a first opening member and a second opening member in which workpiece passing ports where the transferred workpiece passes are formed; and a sheet shutter, the sheet shutter is provided with a winding portion and a shutter portion, the shutter portion is disposed between the first opening member and the second opening member, the shutter portion is provided with a first sheet portion which covers the workpiece passing port of the first opening member and a second
(Continued)

sheet portion which covers the workpiece passing port of the second opening member at a time that the shutter portion is closed, and it is configured that a gas storage portion is formed between the first opening member and the second opening member at the time that the shutter portion is closed.

5 Claims, 7 Drawing Sheets

(51) Int. Cl.
*F27B 9/32* (2006.01)
*F27B 9/30* (2006.01)
*F27B 9/20* (2006.01)

(58) Field of Classification Search
USPC ..... 266/280; 110/112, 116; 432/120, 128, 432/129
See application file for complete search history.

(56) References Cited

U.S. PATENT DOCUMENTS

| | | | | |
|---|---|---|---|---|
| 9,637,974 | B2 * | 5/2017 | Thompson | A62C 2/10 |
| 2004/0161721 | A1 | 8/2004 | Patel et al. | |

FOREIGN PATENT DOCUMENTS

| | | |
|---|---|---|
| JP | 58-180268 | 12/1983 |
| JP | 61-137652 | 8/1986 |
| JP | 2000-161863 | 6/2000 |
| JP | 2007-187398 | 7/2007 |
| JP | 2010-43795 | 2/2010 |

OTHER PUBLICATIONS

Foreign Office Action issued in India Application No. 201817033369, dated Jun. 19, 2020.

* cited by examiner

DOOR STRUCTURE OF HEAT TREATMENT FURNACE

TECHNICAL FIELD

The present invention relates to a door structure of a heat treatment furnace which performs heat treatment of a workpiece.

BACKGROUND ART

In a process of manufacturing an automotive part or other machine structural parts, various heat treatments are performed on a workpiece in accordance with purposes such as improvement of strength of a member and improvement of abrasion resistance. It is required that the heat treatment furnace to perform the heat treatment of the workpiece should maintain a furnace interior in a predetermined atmosphere. In particular, at an entrance part of the heat treatment furnace for carrying in or carrying out the workpiece, a temperature difference between the furnace interior and a furnace exterior is large, and thus a structure of a door is required to have excellent airtightness and heat-insulating property in view of heat energy efficiency.

As a conventional door structure used for a heat treatment furnace, Patent Document 1 discloses a structure in which a lifting door using a cylinder is pressed to a furnace body. Patent Document 2 discloses a structure in which a hanging shield curtain having a flexibility and a heat resistance is provided. Patent Document 3 discloses a structure in which a sheet door with a high airtightness is provided.

PRIOR ART DOCUMENT

Patent Document

Patent Document 1: Japanese Utility Model Application Publication No. S56-88100

Patent Document 2: Japanese Utility Model Application Publication No. S61-137652

Patent Document 3: Japanese Laid-open Patent Publication No. 2000-161863

SUMMARY OF THE INVENTION

Problems to be Solved by the Invention

However, a structure in which a door is raised/lowered by using a cylinder as in Patent Document 1 and a structure in which a door is fixed by using a clamping mechanism have a problem of high cost or the like. Besides, application of a heat insulator on the door is necessary in order to block transfer of heat between a furnace interior and a furnace exterior. Therefore, a door structure becomes complicated and extensive, bringing about an increase in weight and an increase in occupied space.

Meanwhile, in a case where the door is made of a sheet as in Patent Document 2 and Patent Document 3, a door main body is light-weighted compared with a case of Patent Document 1, so that a cost for installing the door can be made low. However, door structures as in Patent Document 2 and Patent Document 3 are not sufficient in heat-insulating property, so that there is a problem of a bad heat energy efficiency.

The present invention is made in view of the above-described circumstances, and an object thereof is to provide a door for a heat treatment furnace which has a light-weighted and simple structure and has sufficient airtightness and heat-insulating property.

Means for Solving the Problems

The present invention to solve the above-described problem is a door structure of a heat treatment furnace performing a heat treatment of a workpiece, the door structure having: a first opening member and a second opening member in which workpiece passing ports where the transferred workpiece passes are formed; and a sheet shutter which blocks an atmosphere by raising and lowering a sheet material, wherein the first opening member and the second opening member are disposed to face each other, and the sheet shutter has: a winding portion which winds the sheet material; and a shutter portion which is raised and lowered by an action of the winding portion, wherein the shutter portion is disposed between the first opening member and the second opening member and has a first sheet portion which covers the workpiece passing port of the first opening member and a second sheet portion which covers the workpiece passing port of the second opening member at a time that the shutter portion is closed, and it is configured that a gas storage portion in which gas flowing from a furnace interior is stored is formed between the first opening member and the second opening member at the time that the shutter portion is closed.

Effect of the Invention

According to the present invention, it is possible to make a door of a heat treatment furnace have a light-weighted and simple structure, and sufficient airtightness and heat-insulating property can be secured.

MODES FOR CARRYING OUT INVENTION

Figure 1:
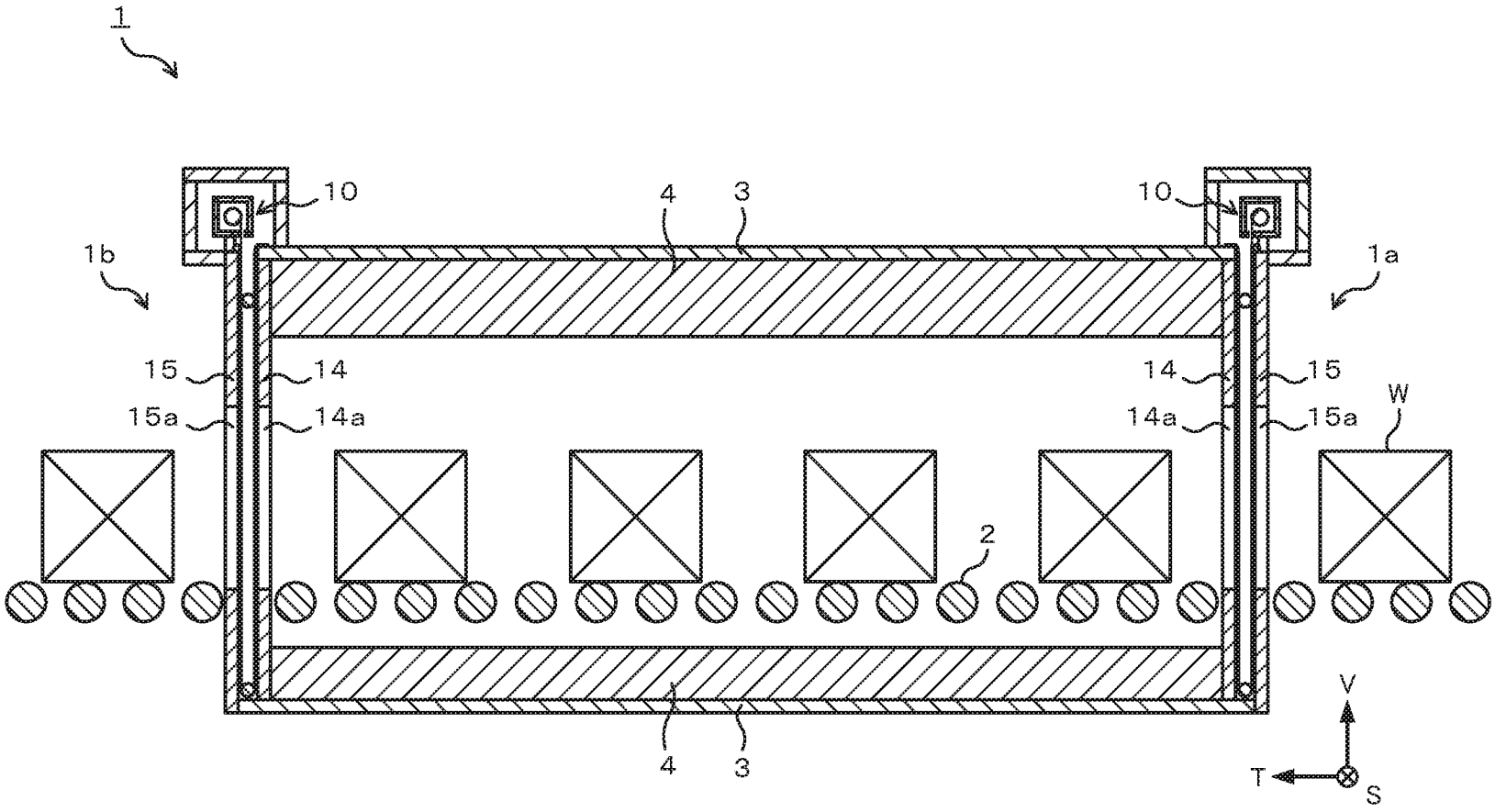
FIG. 1 is a schematic view illustrating an application example of a door structure according to an embodiment of the present invention, which illustrates a schematic configuration of a continuous tempering furnace with this door structure.

A door structure of a heat treatment furnace according to the present invention is applied to a heat treatment furnace such as a heating furnace, a carburizing furnace, a quenching furnace, or a tempering furnace, for example. Hereinafter, as an embodiment of the present invention, there is described an embodiment in which the door structure according to the present invention is applied to a door of a continuous tempering furnace. Note that in this specification and drawings, the same reference numeral is given to a component having practically the same function, to thereby omit redundant explanation.

As illustrated in FIG. 1, a continuous tempering furnace 1 in this embodiment is a roller hearth tempering furnace. A workpiece W having been transferred to a furnace interior from an entry side 1*a* of the tempering furnace 1 is transferred along a transfer direction T by a transfer roller 2. Two transfer lines of the workpiece W are provided in the furnace along a plane vertical direction in FIG. 1, that is, a furnace width direction S. A heat insulator 4 is provided inside furnace walls 3 of a furnace ceiling portion and a furnace floor portion. A radiant tube heater of a bellows shape (not shown) is provided inside the furnace, and the furnace interior is heated to about 200° C., which is a tempering temperature.

Figure 2:
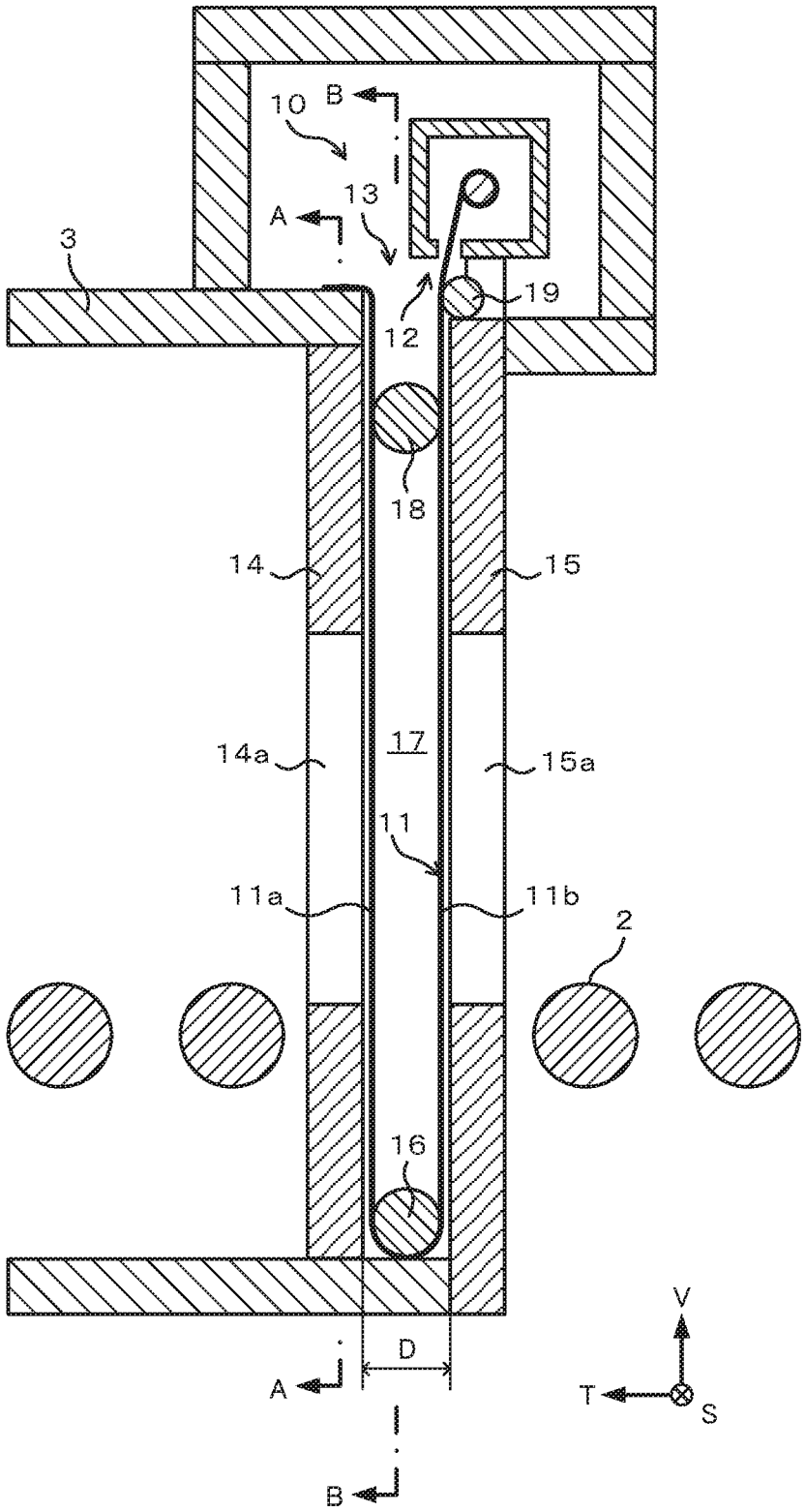
FIG. 2 is a schematic view of the door structure on a tempering furnace entry side according to the embodiment of the present invention.

On the entry side 1*a* of the furnace where the workpiece W is carried in and an exit side 1*b* of the furnace where the workpiece W is carried out, there are provided sheet shutters 10 which block atmospheres of the furnace interior and the furnace exterior. As illustrated in FIG. 2, the sheet shutter 10 is constituted by a winding portion 12 which winds a sheet material 11, and a shutter portion 13 which is raised/lowered by an action of the winding portion 12. The winding portion 12 is provided with a common winding device. Further, the winding portion 12 is surrounded by the furnace wall 3. The sheet material 11 according to this embodiment, which is formed of a glass cloth (what is called a coated glass cloth) made by using heat resistant fiber, has a heat resistance such that its heatproof temperature is equal to or higher than a furnace interior temperature.

Two opening members of a first opening member 14 and a second opening member 15 are provided at an installation position of the sheet shutter 10. Both the first opening member 14 and the second opening member 15 are provided vertically in relation to a furnace floor and are provided to face each other with a predetermined interval D. The interval D is provided appropriately in correspondence with a temperature difference between the furnace interior and the furnace exterior, the heat-insulating property the sheet material 11 has, or the like, and the interval D between the first opening member 14 and the second opening member 15 is preferably 10 mm or more in view of the heat-insulating property of the shutter portion 13.

Figure 3:
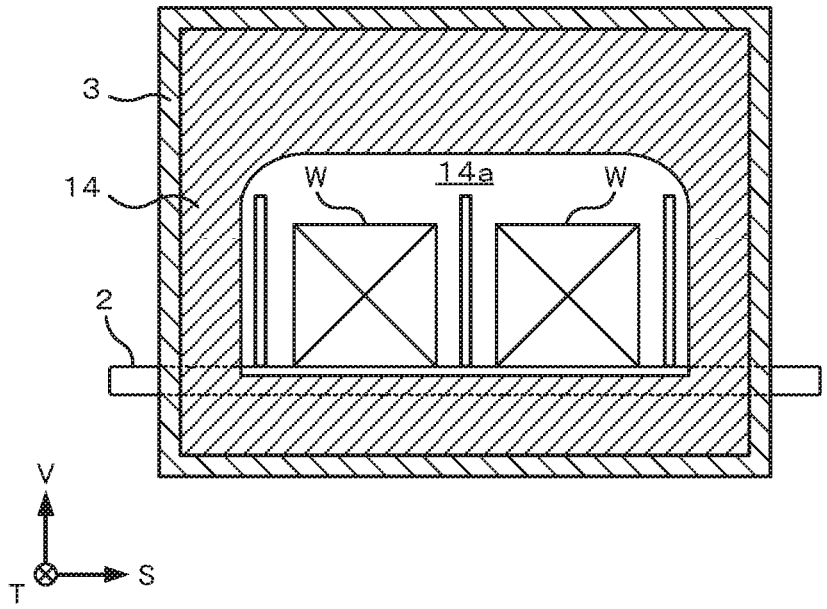
FIG. 3 is a cross-sectional view taken along a line A-A in FIG. 2.

As illustrated in FIG. 2 and FIG. 3, an opening 14*a* (hereinafter, "workpiece passing port") where the workpiece W on the transfer roller can pass is formed in the first opening member 14. At a time that the shutter portion 13 is open, the workpiece W is carried in via this workpiece passing port 14*a*. A workpiece passing port 15*a* of a size similar to that in the first opening member 14 is formed also in the second opening member 15. The first opening member 14 and the second opening member 15 are formed of a material similar to that of the furnace wall 3, for example. Though not illustrated, the first opening member 14 and the second opening member 15 are fixed to the furnace wall 3 by a fixing method such as bolt fastening, for example.

Figure 4:
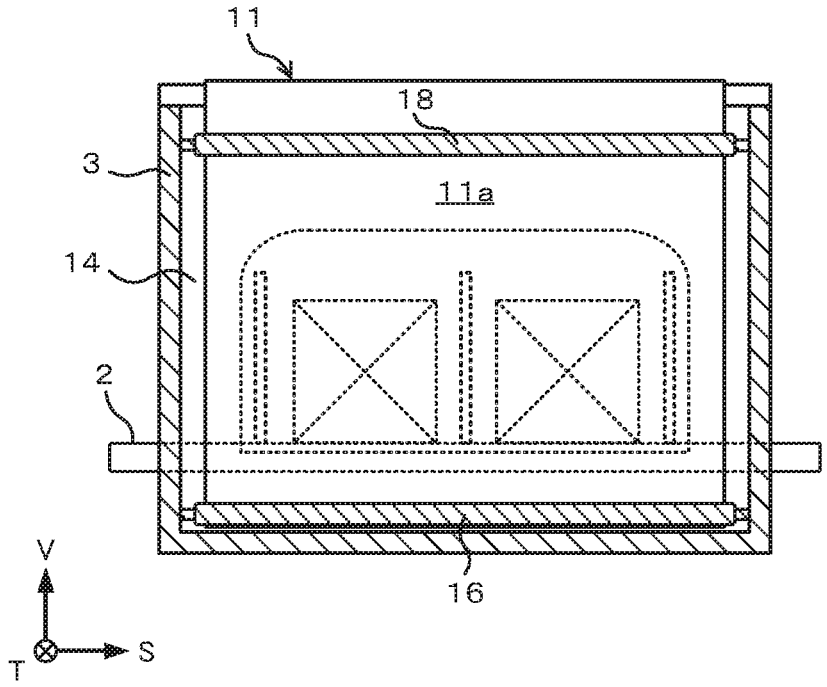
FIG. 4 is a cross-sectional view taken along a line B-B in FIG. 2.

As illustrated in FIG. 2, the sheet shutter 10 is provided in a manner that the shutter portion 13 is positioned between the first opening member 14 and the second opening member 15 at the time that the sheet shutter 10 is closed. Further, as illustrated in FIG. 4, a width of the sheet material 11 has a length enough to cover the workpiece passing port 14*a* of the first opening member 14. As described above, since the workpiece passing port 15*a* of the second opening member 15 also has a shape similar to that of the workpiece passing port 14*a* of the first opening member 14, the workpiece passing port 15*a* of the second opening member 15 is also able to be covered by the sheet material 11 at the time that the shutter portion 13 is closed.

As illustrated in FIG. 2 and FIG. 4, there is provided a column-shaped shaft 16 with a diameter almost the same as the length of the interval D between the first opening member 14 and the second opening member 15 at a lower end of the shutter portion 13. The shaft 16, not fixed to another member such as the furnace wall, is provided rotatably in a circumferential direction. The sheet material 11 sent out from the winding portion 12 is folded by the shaft 16, and a tip portion of the sheet material 11 is fixed to a ceiling portion of the furnace wall 3. That is, in the sheet shutter 10 of this embodiment, the shutter portion 13 has a double structure, and the atmospheres of the furnace interior and the furnace exterior are blocked from each other by a part 11*a* (hereinafter, "first sheet portion") contacting the first opening member 14 of the sheet material 11 and a part 11*b* (hereinafter, "second sheet portion") contacting the second opening member 15 of the sheet material 11. In FIG. 2, spaces are illustrated between each of sheet materials 11*a*, 11*b* and each of opening members 14, 15 for the sake of convenience of explanation of the door structure of this embodiment, but in reality they are in contact with each other.

Further, as illustrated in FIG. 2, the first sheet portion 11*a* and the second sheet portion 11*b* are provided to cover respectively the first opening member 14 and the second opening member 15 which are disposed apart from each other with the predetermined interval D, and thereby spaces are formed therebetween. Since the atmosphere of the furnace interior has a higher temperature in relation to the furnace exterior, the furnace interior has a positive pressure in relation to the furnace exterior, so that gas of the furnace interior is likely to flow toward the furnace exterior at the time that the shutter portion 13 is open. Consequently, at a time that the shutter portion 13 starts to be closed, that is, while the shutter portion 13 is being lowered, the gas of the furnace interior flows from a furnace width direction S to the space between the first sheet portion 11*a* and the second sheet portion 11*b*. As described above, since the winding portion 12 is surrounded by the furnace wall 3 and the shutter portion 13 is sandwiched by the first opening member 14 and the second opening member 15, at the time that the shutter portion 13 is closed, there is formed a closed space 17 isolated from the atmosphere on a side where the shutter portion 13 is not provided of the first opening member 14 and from the atmosphere on a side where the shutter portion 13 is not provided of the second opening member 15. Consequently, the gas flown into between the first sheet portion 11*a* and the second sheet portion 11*b* at the time that the shutter 13 is lowered is stored in the closed space 17 at the time that the shutter portion 13 is closed. In the description hereinafter, the closed space 17 in which the gas is stored is referred to as a "gas storage portion". Here, "isolated" means that the space is separated by objects such as the sheet material 11 and the furnace wall 3. In order to obtain an effect of the present invention, it suffices that the sheet material 11 is in contact with major parts of the first opening member 14 and the second opening member 15, and the gas storage portion 17 is not necessarily required to be tightly sealed. Further, in this embodiment, though the furnace interior positive pressure due to the temperature difference between inside and outside the furnace is described, it suffices that the furnace interior is made to have a positive pressure as a result of providing another mechanism such as a gas supply mechanism.

Note that setting the interval D between the first opening member 14 and the second opening member 15 to 10 mm or more enables the gas to intervene between the first sheet portion 11*a* and the second sheet portion 11*b* without allowing the sheet portions 11*a*, 11*b* to contact with each other even if the sheet portions 11*a*, 11*b* have some deflection, so that a heat-insulating property of the shutter portion 13 is secured.

The shaft 16 provided at the lower end of the shutter portion 13 is raised and lowered together with the sheet material 11, while rotating in the circumferential direction at the time of raising and lowering of the shutter portion 13. Since the shaft 16 is not fixed to another member, a tension in a vertical direction V is generated by the own weight of the shaft 16 in the sheet material 11. Thereby, the deflection of the sheet material 11 at the time that the sheet shutter 10 is closed is suppressed. Consequently, the shutter portion 13 becomes likely to closely adhere to each of the opening members 14, 15, so that the airtightness of the shutter portion 13 is improved. Further, in this embodiment, a length of the shaft 16 is larger than the entire width of the sheet material. Thereby, the tension in the vertical direction is generated in the sheet material 11 in the entire region in the furnace width direction at the time of the opening/closing action of the shutter portion 13, resulting in stable suppression of flip-flopping of the sheet material 11. Note that a shaft diameter is appropriately set to be able to secure the airtightness of the shutter portion 13 sufficiently, in consideration of the interval D between the first opening member 14 and the second opening member 15, a thickness of the sheet material 11, or the like.

As illustrated in FIG. 2, a guide pipe 18 is provided between the first sheet portion 11*a* and the second sheet portion 11*b* and above the workpiece passing ports 14*a*, 15*a* of the first opening member 14 and the second opening member 15. A diameter of the guide pipe 18 is almost the same as the length of the interval D between the first opening member 14 and the second opening member 15. The tension is generated in the sheet material 11 of the shutter portion 13 due to the own weight of the shaft 16. However, if a distance to the lower end of the shutter portion 13 from the winding portion 12 becomes large at the time that the shutter portion 13 is lowered, the sheet material 11 may float between the shutter portion lower end and the winding portion 12. Meanwhile, if the guide pipe 18 is provided as in this embodiment, a supporting point of the sheet material 11 is generated between the shutter portion lower end and the winding portion 12, so that floating of the sheet material 11 can be suppressed at the time that the shutter portion 13 is lowered. Thereby, the shutter portion 13 and each of the opening members 14, 15 become likely to adhere closely to each other, leading to improvement of the airtightness of the shutter portion 13.

Further, as illustrated in FIG. 2, in an upper surface part of the second opening member 15, there is provided a guide roller 19 to be contacted by the sheet material 11 sent from the winding portion 12. The guide roller 19 prevents contact between the sheet material 11 and an upper surface corner portion of the second opening member 15 and suppresses damage of the sheet material 11 due to repetition of opening/closing actions of the shutter portion 13.

As described above, the door structure of the tempering furnace 1 according to this embodiment is a structure in which the first opening member 14, the first sheet portion 11*a*, the second sheet portion 11*b*, and the second opening member 15 are provided in sequence from the furnace interior side. Though in FIG. 2 to FIG. 4 the door structure of the entry side 1*a* of the tempering furnace 1 is illustrated, the door structure of the exit side 1*b* of the tempering furnace 1 is the same as that of the entry side 1*a*.

Next, an action of the sheet shutter 10 of this embodiment will be described.

Figure 5:
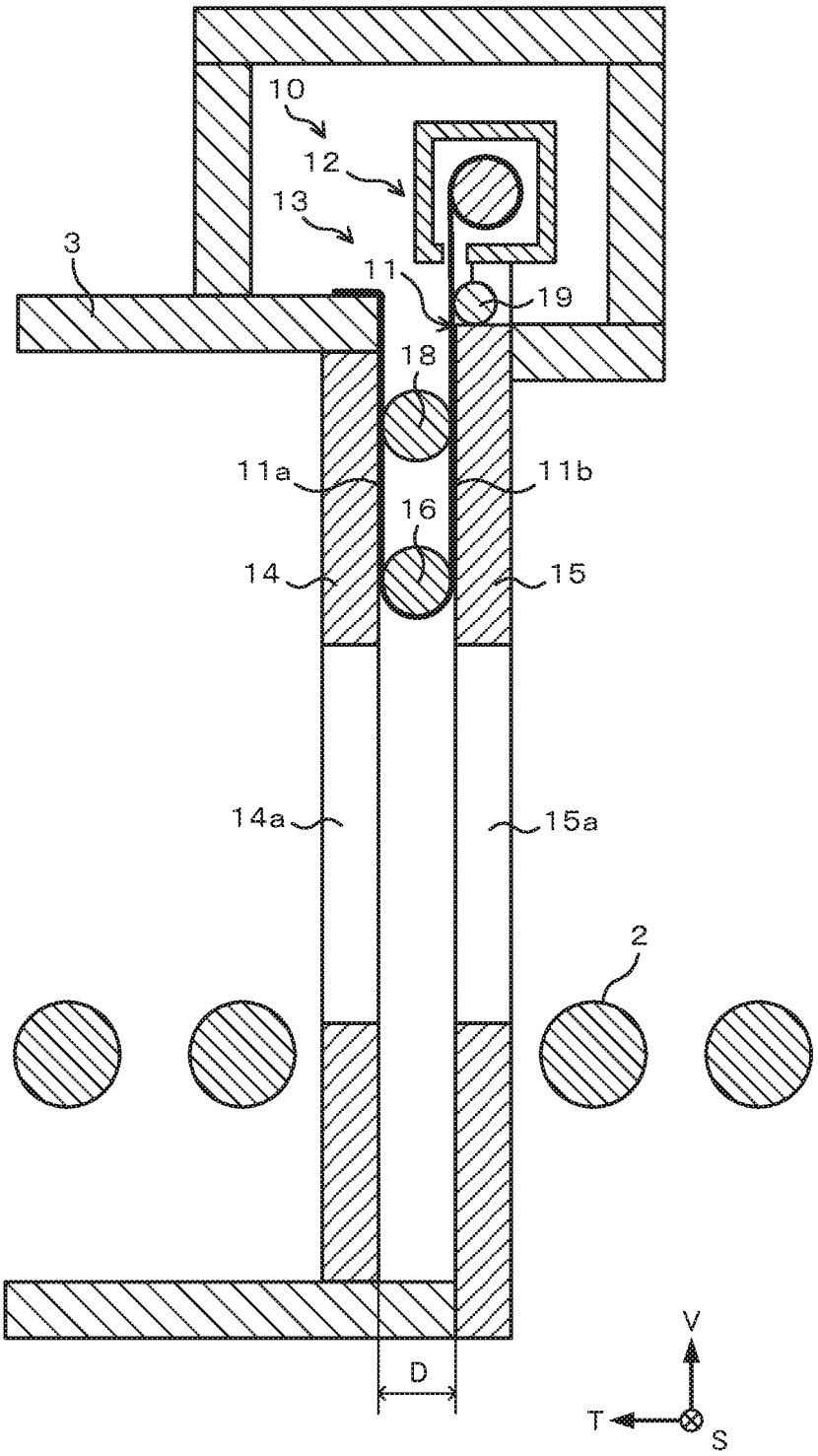
FIG. 5 is a view illustrating a status at a time that a sheet shutter according to the embodiment of the present invention is open.

First, as illustrated in FIG. 5, at the time that the shutter portion 13 is open, the sheet material 11 is in a state of being wound by the winding portion 12 and the lower end of the shutter portion 13 is positioned above the workpiece passing ports 14*a*, 15*a* of the first opening member 14 and the second opening member 15. The workpiece W is transferred to the furnace interior or transferred to the furnace exterior in this state.

Figure 6:
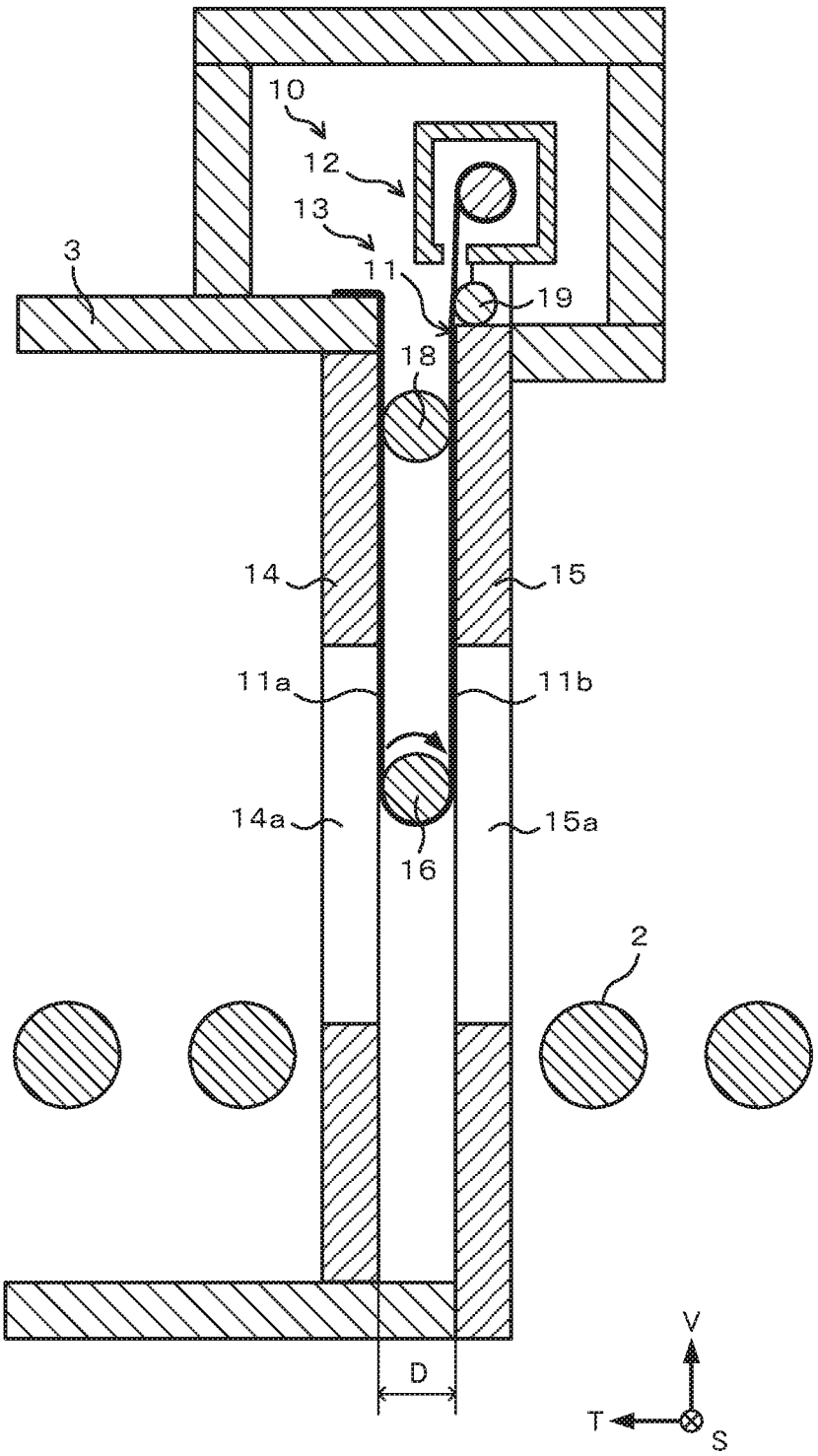
FIG. 6 is a view illustrating a status at a time that the sheet shutter according to the embodiment of the present invention is being closed.

After the action of carrying in/out the workpiece W is finished, a closing action of the shutter portion 13 is started as illustrated in FIG. 6. Here, the shaft 16 is lowered while rotating in the circumferential direction and the sheet material 11 is sent out of the winding portion 12 while receiving the tension generated by the own weight of the shaft 16. At this time, the gas of the furnace interior flows into between the first sheet portion 11*a* and the second sheet portion 11*b* from the furnace width direction S.

Figure 7:
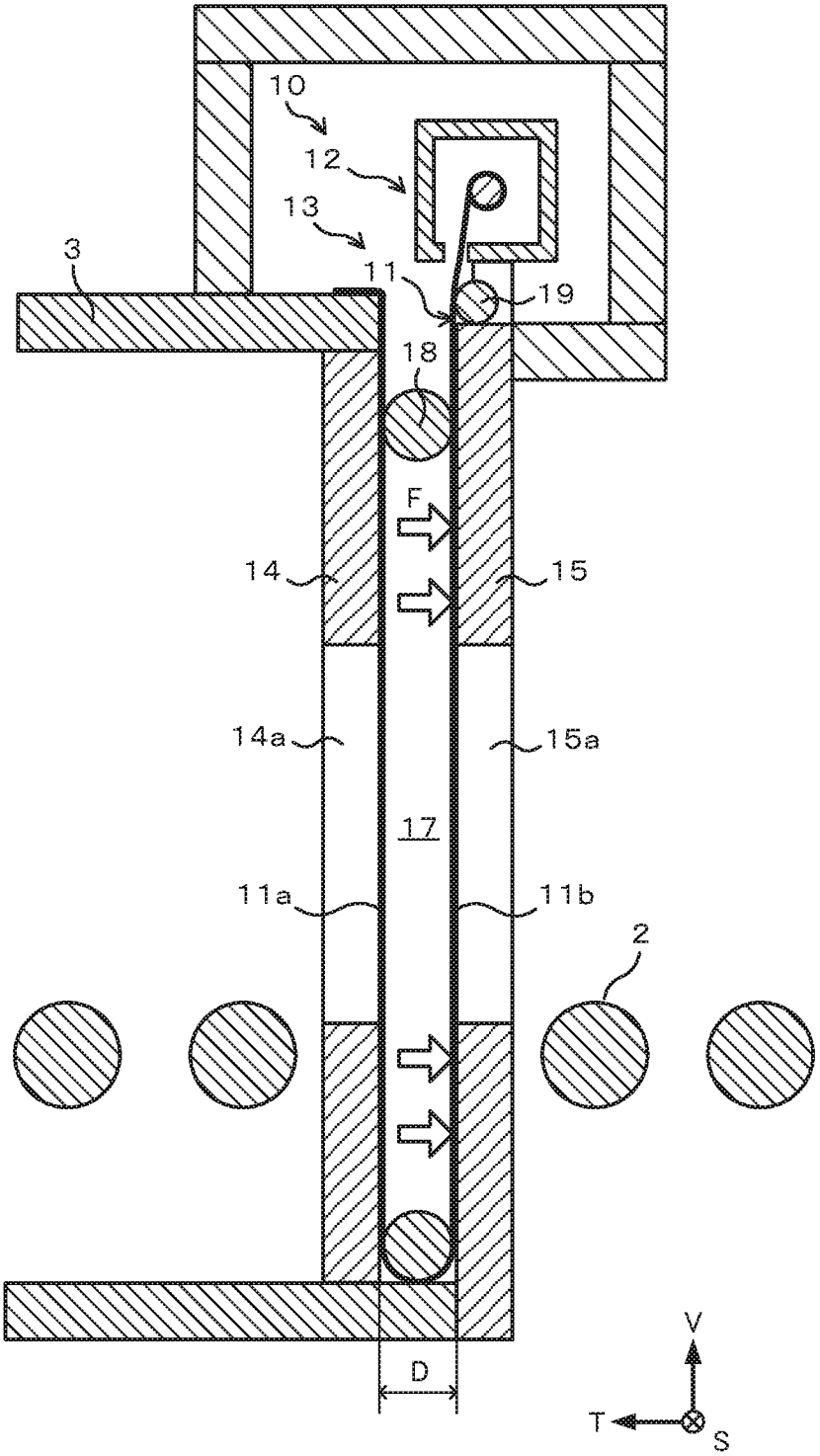
FIG. 7 is a view illustrating a status at a time that the sheet shutter according to the embodiment of the present invention is closed.

Subsequently, as illustrated in FIG. 7, when the lower end of the shutter portion 13 reaches the furnace floor portion, the workpiece passing port 14*a* of the first opening member 14 is covered by the first sheet portion 11*a* and the workpiece passing port 15*a* of the second opening member 15 is covered by the second sheet portion 11*b*. At this time, the gas of the furnace interior which is high in temperature in relation to the furnace exterior is stored in the gas storage portion 17 formed between the first opening member 14 and the second opening member 15, so that an atmospheric temperature is high. Therefore, a pressure inside the gas storage portion is higher in relation to an ambient pressure (atmospheric pressure) of the furnace exterior. Consequently, the sheet material 11 receives a force F to press the second sheet portion 11*b* against the second opening member 15 from the gas storage portion side, so that the second sheet portion 11*b* and the second opening member 15 are closely adhered. Thereby, it becomes possible to suppress inflow of outside air from a space between the second sheet portion 11*b* and the workpiece passing port 15*a*.

As illustrated in FIG. 7, in this embodiment, the shutter portion 13 is lowered until the lower end of the shutter portion 13 reaches the furnace floor portion, but the lower end of the shutter portion 13 is not necessarily required to reach the furnace floor portion. It suffices that the shutter portion 13 is lowered to a height which enables the sheet material 11 to cover the workpiece passing port 14*a* of the first opening member 14 and the workpiece passing port 15*a* of the second opening member 15.

At this time, among surfaces on the furnace exterior side of the second sheet portion 11*b*, the surface around the workpiece passing port 15*a* is in contact with the furnace exterior atmosphere whose temperature is lower in relation to the furnace interior temperature. However, since there is a space between the first sheet portion 11*a* and the second sheet portion 11*b*, the first sheet portion 11*a* and the second sheet portion 11*b* are not in contact with each other in the neighborhood of the workpiece passing port 14*a*, resulting in that heat conduction due to contact does not occur between them. Meanwhile, though heat transfer to the furnace exterior occurs via the second sheet portion 11*b*, a decrease of the atmospheric temperature of the gas storage portion 17 via the second sheet portion 11*b* takes time because high-temperature gas of the furnace interior is stored in the gas storage portion 17. In other words, a temperature difference between the atmospheric temperature of the furnace interior and the atmospheric temperature of the gas storage portion 17 is smaller compared with a temperature difference between the furnace interior and the furnace exterior. Therefore, heat loss from the furnace interior to the gas storage portion 17 via the first sheet portion 11*a* is suppressed, making it easy to keep the furnace interior temperature high.

As described above, by making the sheet shutter 10 have the double structure and the structure in which the interval exists between the first sheet portion 11*a* and the second sheet portion 11*b* as in this embodiment, it becomes possible to make the door structure simpler than conventional structures and to secure sufficient airtightness and heat-insulating property.

Note that in this embodiment the door structure having the sheet shutter 10 and the opening members 14, 15 is each provided in the entry side 1*a* and the exist side 1*b* of the furnace, but a position at which the door structure is provided is not limited to the entry side 1*a* or the exist side 1*b* of the furnace. For example, there are cases where a plurality of processing chambers are provided in a furnace, depending on a structure of a continuous furnace. In the case of such a structure, a temperature difference or a pressure difference sometimes occurs between the adjacent processing chambers in the furnace. The door structure of the embodiment described above can be adopted also as a partition door to separate atmospheres of such processing chambers. In this case, a sheet material 11 is pressed to the adjacent processing chamber from a side of the chamber having a positive pressure in relation to the adjacent processing chamber, to thereby enable securing an airtightness and a heat-insulating property. However, the door structure according to this embodiment attains a more prominent effect when provided in a place to block atmospheres having a large temperature difference, and it is more preferable that the door structure of this embodiment is provided in at least either one of an entry side 1*a* of a furnace where a workpiece W is carried in and an exist side 1*b* of the furnace where the workpiece is carried out.

Further, in this embodiment, the shaft 16 is provided between the first opening member 14 and the second opening member 15 as a sheet weight. However, even if the shaft 16 is not provided, the airtightness of the shutter portion 13 can be secured by appropriately setting the interval D between the first opening member 14 and the second opening member 15, a smoothness of each of the opening members 14, 15, a thickness of the sheet material 11, a smoothness of the sheet material 11, or the like. However, in view of improvement of the airtightness, it is preferable to provide the shaft 16 as the embodiment described above. Note that the shaft 16 may not be the cylindrical member as long as a long member is provided which enables the shutter portion 13 to closely adhere to each of the opening members 14, 15 sufficiently and functions as a sheet weight of the shutter portion 13.

Further, in this embodiment, the guide pipe 18 is provided between the first sheet portion 11*a* and the second sheet portion 11*b*. However, even if the guide pipe 18 is not provided, the airtightness of the shutter portion 13 can be secured by appropriately setting the interval D between the first opening member 14 and the second opening member 15, a position of the winding portion 12 of the sheet material 11, or the like. However, in view of improvement of the airtightness, it is preferable to provide the guide pipe 18. Further, in this embodiment the pipe is used as the guide member, but it is possible to use a roller rotatable in a circumference direction as the guide member. Further, the guide member is not necessarily required to be cylindrical. That is, the airtightness can be improved by providing a guide member which can suppress floating of the first sheet portion 11*a* and the second sheet portion 11*b* between the first sheet portion 11*a* and the second sheet portion 11*b* and above the workpiece passing ports 14*a*, 15*a* of the first opening member 14 and the second opening member 15.

Hereinabove, the embodiment of the present invention was described, but the present invention is not limited to such an example. It is obvious that a person skilled in the art can devise various modification examples or correction examples within a scope of technical ideas described in claims, and it is a matter of course that those examples should also be understood to belong to the technical scope of the present invention.

Figure 8:
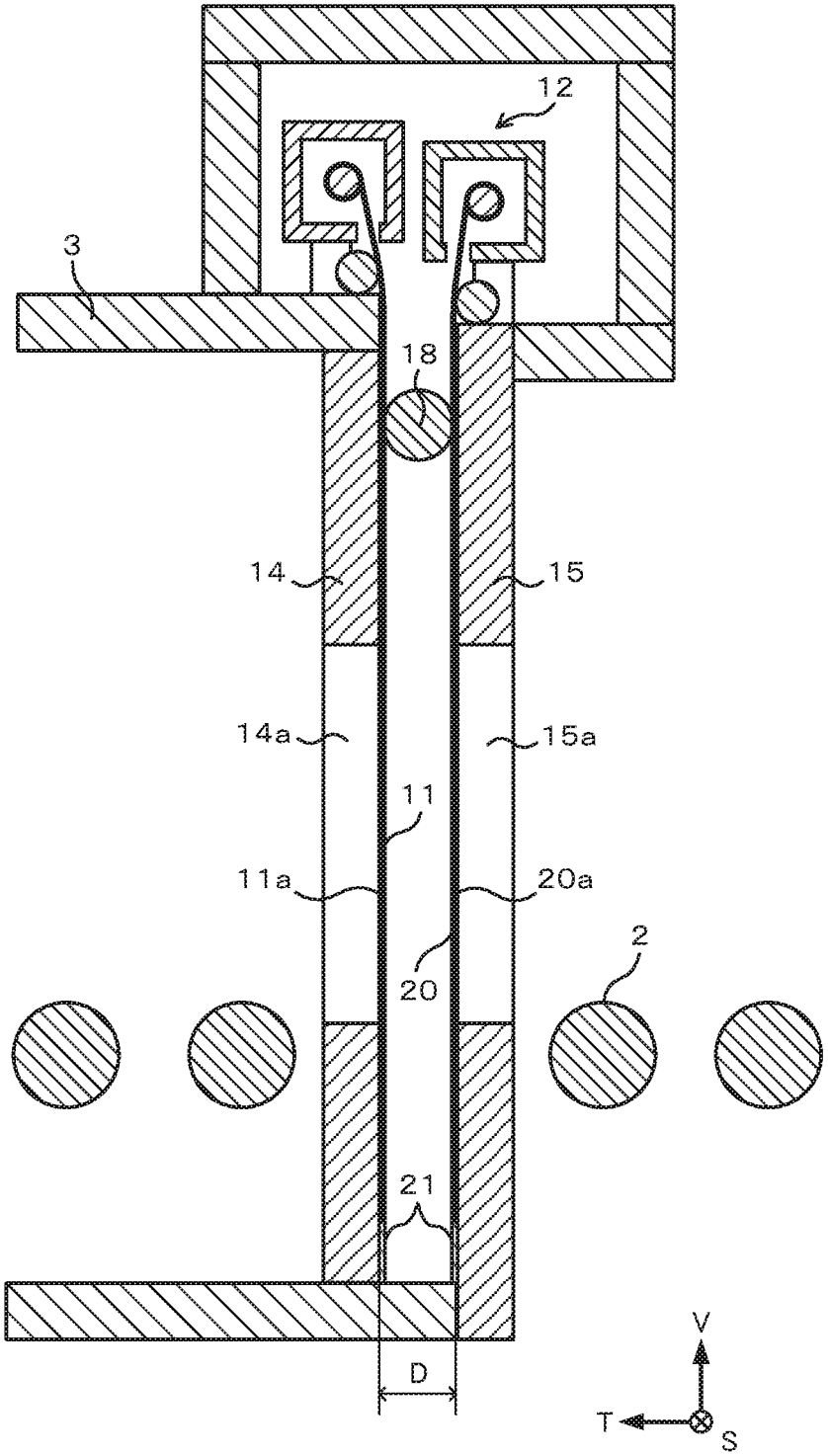
FIG. 8 is a schematic view illustrating a configuration of a door structure according to another embodiment of the present invention.

For example, in the above-described embodiment, one sheet material 11 is folded to form the first sheet portion 11*a* and the second sheet portion 11*b*. However, as illustrate in FIG. 8, two sheet materials 11, 20 may be used to constitute a sheet shutter 10 as a first sheet portion 11*a* and a second sheet portion 20*a*. In this case, for example, two winding devices are provided in a winding portion 12, and plates 21 with small plate thicknesses are attached as sheet weights to lower ends of the sheet materials 11, 20. Also in this case, a gas storage portion 17 as described in the aforementioned embodiment is formed between the first sheet portion 11*a* and the second sheet portion 20*a* at a time that the shutter is closed, so that an airtightness and a heat-insulating property can be secured sufficiently. However, in view of simplification of the door structure, the structure in which one sheet material 11 is folded is preferable. Note that two or more sheet materials may be bonded to each other to constitute one sheet material.

EXAMPLES

A door structure of a heat treatment furnace according to the present invention was adopted as a door structure of an entry side and an exist side of a continuous tempering furnace and a tempering treatment of a workpiece was carried out. The door structure according to the present invention is a structure illustrated in FIG. 2. With a target soaking temperature of the tempering treatment being set to 150±7.5° C., there were measured a heating up time from carrying in the workpiece until reaching the target soaking temperature, a retention time (soaking time) from reaching the target soaking temperature, and an overshoot temperature in relation to a median value of the target soaking temperature at the time of heating up. Results are listed in Table 1 below. Target values in Table 1 indicate a heating up time, a soaking time, and an overshoot temperature which are required of a conventional iron door structure. Note that a sheathed thermocouple is used for temperature measurement of the workpiece in the furnace.

TABLE 1

| | TARGET VALUE (CONVENTIONAL FURNACE LEVEL) | FURNACE ACCORDING TO PRESENT INVENTION | JUDGMENT |
|---|---|---|---|
| HEATING UP TIME | 60 MINUTES OR SHORTER | 51 MINUTES | ACCEPTABLE |
| SOAKING TIME | 90 MINUTES OR LONGER | 99 MINUTES | ACCEPTABLE |
| OVERSHOOT TEMPERATURE | 7.5° C. OR LOWER | 7.3° C. | ACCEPTABLE |

As listed in Table 1, in the tempering furnace using the door structure according to the present invention, the heating up time until reaching the soaking temperature was within a range of the target value. Further, since the door structure has the sufficient heat-insulating property, the target time was able to be attained also in terms of the soaking time. The overshoot temperature was also at an acceptable level. In other words, when the door structure according to the present invention is used, the structure can be made simpler than that of the conventional furnace and a heat-insulating property at the level of the conventional furnace can be secured.

INDUSTRIAL APPLICABILITY

The present invention is applicable to a tempering furnace which carries out a tempering treatment of a workpiece.

EXPLANATION OF CODES

1 continuous tempering furnace
1*a* entry side of furnace
1*b* exit side of furnace
2 transfer roller
3 furnace wall
4 heat insulator
10 sheet shutter
11 sheet material
11*a* first sheet portion
11*b* second sheet portion
12 winding portion
13 shutter portion
14 first opening member
14*a* workpiece passing port of first opening member
15 second opening member
15*a* workpiece passing port of second opening member
16 shaft
17 gas storage portion
18 guide pipe
19 guide roller
20 sheet material
20*a* second sheet portion
21 plate
D interval between first opening member and second opening member
F pressing force
S furnace width direction
T transfer direction
V vertical direction
W workpiece

The invention claimed is:

1. A door structure of a heat treatment furnace performing a heat treatment of a workpiece, the door structure comprising:

a first opening member and a second opening member in which workpiece passing ports where a transferred workpiece passes are formed; and a sheet shutter which blocks outward flow of furnace interior atmosphere by raising and lowering a sheet material, wherein the first opening member and the second opening member are disposed to face each other, and the sheet shutter comprises:

a winding portion which winds the sheet material; and a shutter portion which is raised and lowered by an action of the winding portion, wherein the shutter portion is disposed between the first opening member and the second opening member and has a first sheet portion which covers the workpiece passing port of the first opening member and a second sheet portion which covers the workpiece passing port of the second opening member at a time that the shutter portion is lowered, and it is configured that a gas storage portion in which gas flowing from a furnace interior is stored is formed between the first opening member and the second opening member at the time that the shutter portion is lowered.

2. The door structure of the heat treatment furnace according to claim 1, wherein a long member provided rotatably in a circumferential direction is disposed at a lower end of the shutter portion, and the first sheet portion and the second sheet portion are constituted by one sheet material being folded by the long member.

3. The door structure of the heat treatment furnace according to claim 2, wherein a length of the long member is larger than an entire width of the sheet material.

4. The door structure of the heat treatment furnace according to claim 1, wherein a guide member which suppresses deflection of the sheet material is provided between the first sheet portion and the second sheet portion and above the workpiece passing ports.

5. The door structure of the heat treatment furnace according to claim 1, wherein an interval between the first opening member and the second opening member is 10 mm or more.

* * * * *